United States Patent [19]

Eastwood

[11] 4,399,985

[45] Aug. 23, 1983

[54] METALLURGICAL LANCE

[75] Inventor: Owen Eastwood, Worksop, England

[73] Assignee: Monoconstruction Limited, England

[21] Appl. No.: 364,232

[22] Filed: Apr. 1, 1982

[30] Foreign Application Priority Data

Apr. 2, 1981 [GB] United Kingdom ..... 8110332
Jul. 1, 1981 [GB] United Kingdom ..... 8120239

[51] Int. Cl.[3] ..... C21B 7/16
[52] U.S. Cl. ..... 266/265; 75/60
[58] Field of Search ..... 75/60; 266/265

[56] References Cited

U.S. PATENT DOCUMENTS 3,342,473 9/1967 White ..... 266/265

*Primary Examiner*—P. D. Rosenberg
*Attorney, Agent, or Firm*—King and Liles

[57] ABSTRACT

The invention relates to metallurgical lances. Normally such lances are formed by a heavy metal tube encased in a refractory sleeve and because of their relatively long length such lances flex in use thereby propogating cracks in the refractory and encouraging the growth of cracks that are otherwise formed during shock loading of the lance as it enters the bath of metal and because of differential expansion that occurs between the refractory and the tube. The object of the invention is to provide a lance of high rigidity and reduced tendancy to cracking and spalling which objective is met by a metallurgical lance having a tubular member for the passage of gas or the mixture of gases and solids, said member being encased in a sleeve of an appropriate refractory, there being arranged around the periphery of the tubular member, and spaced therefrom, a number of longitudinal reinforcing members also encased in the refractory sleeve.

16 Claims, 13 Drawing Figures

METALLURGICAL LANCE

This invention relates to metallurgical lances such as are used to inject gases or mixtures of gases and solids below the surface of molten metal in a furnace or ladle.

Normally lances are formed by a heavy metal tube encased in a refractory sleeve, and frequently such lances are relatively of long length. Because of the arduous conditions to be found in a furnace or ladle, and the shock loading of the lance as it is introduced, e.g., through a slag layer and into the bath of molten metal, the refractory sleeve frequently cracks and spalls, thereby reducing the life of the lance, and it is not unknown for a lance to be unusable after a single lancing operation. With lances of relatively long length, this problem is compounded by the inevitable flexing of the lance during use propogating cracks in the refractory and encouraging the growth of cracks that are otherwise formed, e.g., because of the differential expansion that occurs between the refractory and the metal tube.

The object of the present invention is to provide a metallurgical lance that has a reduced tendancy to crack and spall in comparison with lances known hitherto, and has relatively high rigidity.

According to the present invention, a metallurgical lance comprises a tubular member for the passage of gas or a mixture of gases and solids, said member being encased in a sleeve of an appropriate refractory material, there being arranged around the periphery of the tubular member, and spaced therefrom, a number of longitudinal reinforcing members also encased in the refractory sleeve. Preferably, the reinforcing members are spaced from the tubular member and secured thereto by appropriate spacer members.

By providing a cage or cluster of reinforcing members all encased in the refractory sleeve, the rigidity of the lance is so greatly increased over known lance constructions, that flexing during use is virtually eliminated, thereby removing a major cause of premature lance failure. Because of the increased strength provided by the invention, it is possible to reduce the gauge of the tubular member thereby reducing the steel mass within the sleeve and the production costs of lances, without detracting from the performance or life of the lances. Preferably, the reinforcing members are connected together in pairs, at their lower ends, such that pairs of reinforcing members lie in spaced relationship around the periphery of the tubular member.

Thus, the reinforcing members may be formed from relatively rigid bar or rod-like members of an appropriate metal, and the bar or rod-like members may be bent into U-configuration to form a pair of interconnected reinforcing members. Alternatively separate, solid or tubular U-shaped connecting pieces can be provided and which can be suitably secured to adjacent bar or rod-like members, e.g., by welding. It is further preferred that the bar or rod-like members are of circular section thereby avoiding the presence of sharp corners which can constitute a stress-raising point.

Alternatively the reinforcing members may be tubular, and adjacent tubular members may be interconnected by a U-shaped tubular member, e.g., by welding, or by U-shaped bar-like members again, e.g., by welding. When the reinforcing members are themselves tubular, and, particularly when the tubular reinforcing members are connected in pairs with a U-shaped tubular connection, they, can serve for the passage of cooling fluid along the lance to minimise the effects of shock loading on the refractory sleeve during immersion of the lance, and differential expansion.

The spacing of the reinforcing members from the tubular member allows the refractory material of the sleeve to lie between the reinforcing members and the tubular member. This greatly assists the retention of the refractory material in place during use. To further enhance retention of the refractory material, it is preferred to provide a perforated structure, e.g., a wire mesh sleeve around the cage or cluster of reinforcing members to be embedded in the refractory material, and spacers can be provided to hold the mesh in place prior to embedding in the refractory material.

To minimise, if not eliminate, the disruptive effect of differential thermal expansion between the refractory material of the sleeve and the reinforcing members and the tubular member, the reinforcing members and the tubular member may be provided with a coating of a low melting point compound or heat destructible material and when, on normal firing of the refractory material at, e.g., 300° C. to 500° C., the coatings are removed, to leave a very small gap between the reinforcing members and tubular member, and the refractory material, that can allow differential expansion to take place, without detracting from the ability of the reinforcing members to hold the refractory material in place. It is also preferred to leave exposed the ends of the tubular member and the ends of the reinforcing members at the inlet end of the lance to allow for expansion.

With either tubular or bar-like reinforcing members, the outermost ends can be connected along with the tubular member to a main adaptor also encased in the sleeve of refractory material, the adaptor serving to connect the lance to support mechanism for feeding the lance into a furnace or ladle. Alternatively, and when secondary cooling of the lance is required, the tubular reinforcing members extend to the end of the lance for connection to a suitable source of coolant. Thus a manifold may be provided which can be attached to the end of the lance to provide connections for incoming and outgoing coolant.

Several embodiments of the invention will now be described with reference to the accompanying drawings, in which.

Figure 1:
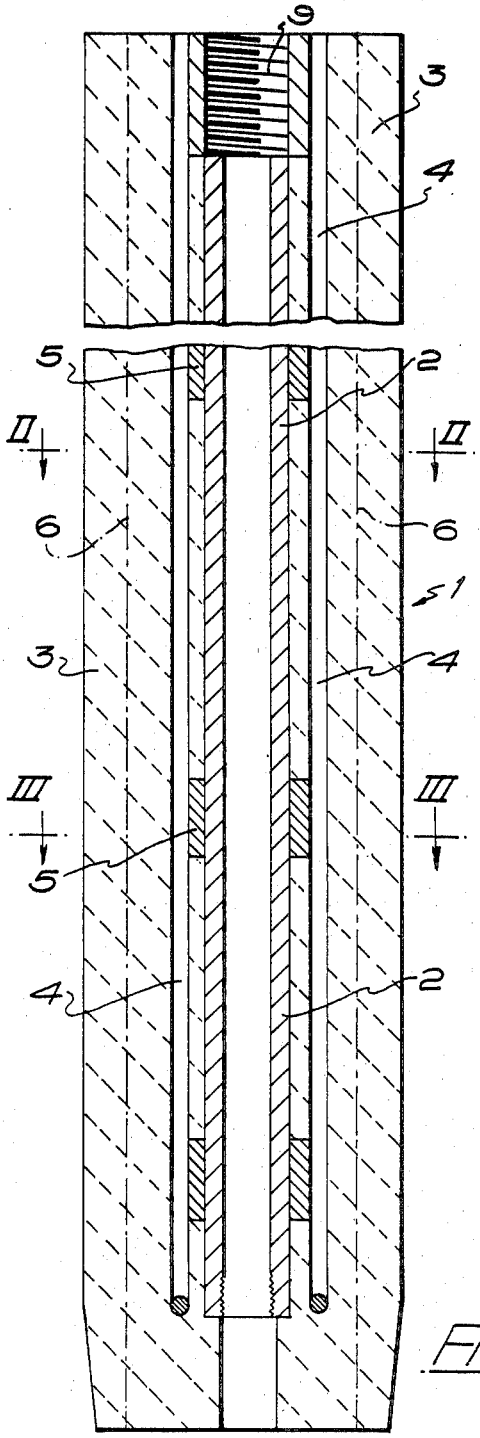
FIG. 1 is a sectional side elevation of a first embodiment of metallurgical lance.
Figure 7:
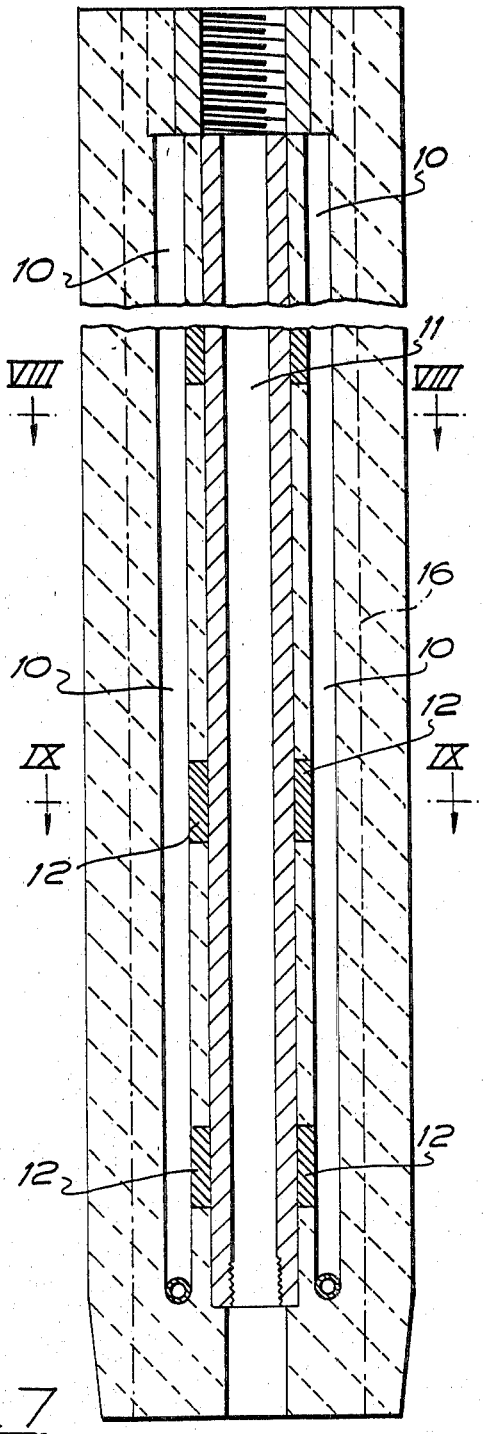
Figure 8:
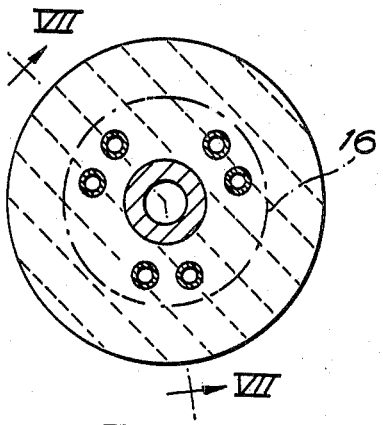
Figure 9:
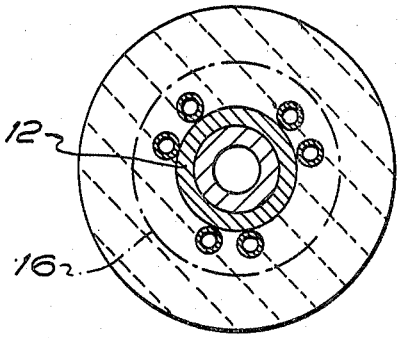

FIG. 7 corresponds to FIG. 1 but shows a second embodiment of metallurgical lance;

FIG. 8 is a section of the line VIII—VIII of FIG. 7;

FIG. 9 is a section on the line IX—IX of FIG. 7; and

FIGS. 10 to 13 show various methods of connecting together adjacent reinforcing members of FIG. 7.

Figure 2:
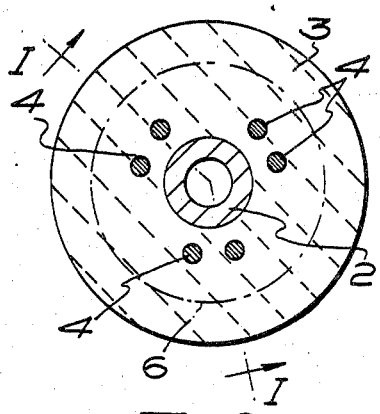
FIG. 2 is a section on the line II—II of FIG. 1.
Figure 3:
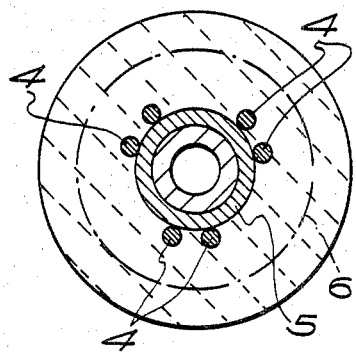
FIG. 3 is a section on the line III—III of FIG. 1.

In FIGS. 1 to 3, a metallurgical lance 1 has a metal tube 2 for the passage of gas or a mixture of gases and solids, the metal tube 2 being encased in a sleeve 3 of refractory material. Surrounding the metal tube 2 and also embedded in the refractory sleeve 3 are six reinforcing members 4 in the form of circular section rods or bars, which rods or bars are, as is shown more particularly by FIGS. 2 and 3 arranged in pairs and spaced from the metal tube 2. The reinforcing rods 4 are held in spaced relationship to the metal tube 2 by spacer membes 5 secured to the rods and to the tube, e.g., by welding. Externally of the reinforcing rods and also embedded in the refractory sleeve is a wire mesh sleeve 6 which, although not illustrated, can be located in spaced relationship to the reinforcing rods by crimping the sleeve on to the rods at one or two points along its length.

Figure 4:
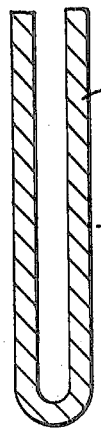
FIGS. 4 to 6 show various methods of connecting together adjacent reinforcing members.
Figure 5:
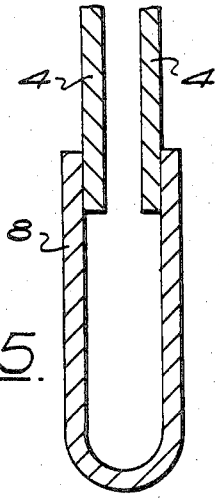
Figure 6:
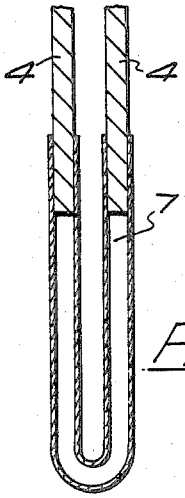

Whilst the reinforcing rods may be individual rods, arranged in pairs, and extending along substantially the full length of the lance, it is preferred that the reinforcing rods of each pair are positively connected together. Thus as is shown by FIG. 4 a single rod 4 may be provided bent into U-configuration. Alternatively as is shown by FIG. 6 the lower ends of individual rods can be connected together by a U-shaped tubular connecting member 7 or, as is shown by FIG. 5, a solid U-shaped connecting member 8.

Preferably, and as illustrated in FIG. 1, the rods 4 and the metal tube 2 are exposed at the inlet end 8 of the lance, although, as is particularly shown, it is preferred that the metal tube 2 at the end is secured to a connector block 9 and whereby the lance can be readily secured to transport mechanism and to a source of gas or gas/solids supply, the reinforcing members also being secured to the connector block, e.g., by welding.

Figure 10:
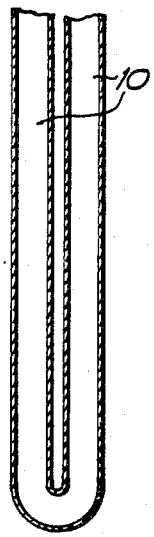
Figure 11:
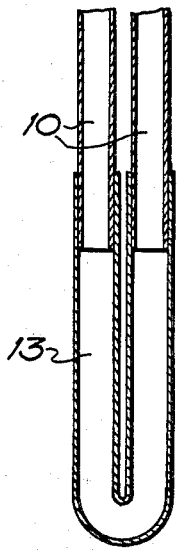
Figure 12:
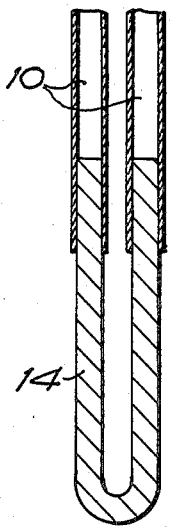
Figure 13:
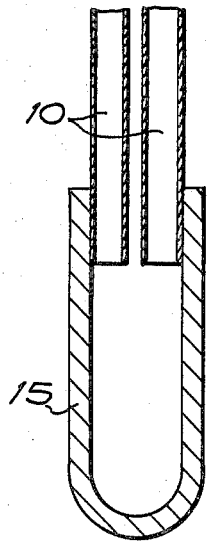

In FIG. 7 is shown a generally similar construction to that shown in FIG. 1, but in this instance the reinforcing members are formed by tubes 10, which tubes 10 as is shown in FIGS. 8 and 9 are arranged in pairs spaced around the periphery of the metal tube 11, and held in spaced relation thereto by spacer members 12. As with the rod construction the tubes 10 may be individual tubes but it is preferred that they are connected together in pairs. Thus, as is shown in FIG. 10 a single tube 10 may be bent into U-configuration or as is shown by FIGS. 11, 12 and 13 individual tubes 10 can be connected by a tubular U-shaped connecting member 13 or solid U-shaped connecting members 14 or 15, respectively. Here again an encircling wire mesh sleeve 16 is provided embedded in the refractory, and the reinforcing tubes 10 and metal tube 11 are exposed at the inlet end of the lance.

Thus, in all its forms, the invention effectively provides a cage or cluster of reinforcing members all substantially totally embedded in and surrounded by the refractory material of the sleeve and consequently the rigidity of the lance is so greatly increased over known lance construction that flexing during use is virtually eliminated thereby removing a major cause of premature lance failure, the increased rigidity provided by the reinforcing structure allowing a metal tube 2 or 11 to be of reduced gauge in comparison with known constructions thereby reducing the mass of metal within the refractory sleeve and hence its weight (with consequent ease of handling) and reducing the costs of production, without detracting from the performance or life of the lance.

By arranging for the ends of the reinforcing members 4 or 10 and the tube 2 or 11 to be exposed at the inlet end of the lance, there is the minimising if not elimination of the desruptive effect of differential thermal expansion between the refractory material of the sleeve and the metal of the reinforcing members and tube. This can be still further enhanced by, prior to the casting of the refractory sleeve in place, coating the tube 2 or 11 and the reinforcing members 4 or 10 with a low melting point compound or heat destructible material such that on firing at, e.g., 300° C. to 500° C., the coatings are removed to leave a very small gap, which cannot effectively be shown in the drawings, between the reinforcing members and the tube, and the refractory material.

During the use of lances in accordance with the invention, the passage of gas or of a gas/solids mixture down the tube 2 or 11 induces a beneficial cooling effect centrally of the lance. This cooling effect can be enhanced by providing the lance with secondary cooling. Thus, when adjacent reinforcing members 10 are connected together as is indicated in FIGS. 10 or 11, the exposed ends of the tubes 10 at the inlet end of the lance can be connected via a suitable manifold to a source of coolant fluid, e.g., air.

I claim:

1. A metallurgical lance comprising a tubular member for the passage of a gas or a mixture of gases and solids, said member being encased in a sleeve of refractory material capable of withstanding the temperature of the molten metal into which it is immersed, there being arranged around the periphery of the tubular member, and spaced therefrom, a number of longitudinal reinforcing members also encased in the refractory sleeve.

2. A metallurgical lance as in claim 1, wherein the reinforcing members are secured to the metal tube by a number of spacer members.

3. A metallurgical lance as in claim 1 or claim 2, wherein the reinforcing members are connected together in pairs, at their lower ends, such that pairs of reinforcing members lie in spaced relationship around the periphery of the tubular member.

4. A metallurgical lance as in any of claims 1 or 2, wherein the reinforcing members are formed from relatively rigid bar or rod-like members of an appropriate metal.

5. A metallurgical lance as in claim 3, wherein the bar or rod-like members are of circular section.

6. A metallurgical lance as in any of claims 1 or 2, wherein the reinforcing members are tubular.

7. A metallurgical lance as in claim 3, wherein the reinforcing members are bent into U-configuration to form a pair of interconnected reinforcing members.

8. A metallurgical lance as in claim 3, wherein separate U-shaped connecting pieces are provided and which are secured to adjacent reinforcing members.

9. A metallurgical lance as in claim 8, wherein the separate U-shaped connecting pieces are themselves solid.

10. A metallurgical lance as in claim 8, wherein separate U-shaped connecting pieces are tabular.

11. A metallurgical lance as in any of claims 1 or 2, wherein a perforated structure encircles the cage or cluster of reinforcing members to be embedded in the refractory material.

12. A metallurgical lance as in claim 11, wherein the perforated structure is a wire mesh sleeve.

13. A metallurgical lance as in any of claims 1 or 2, wherein prior to the formation of the refractory sleeve, the tubular member and the reinforcing members are coated with a low melting point compound or a heat destructible material, removed on firing of the lance to leave a gap between the tubular member and the reinforcing members, and the refractory material.

14. A metallurgical lance as in any of claims 1 or 2, wherein the ends of the tubular member and the ends of the reinforcing members are left exposed at the inlet end of the lance to allow for expansion.

15. A metallurgical lance as in any of claims 1 or 2, wherein the outermost ends of the reinforcing members and the tubular member are connected to a main adaptor also encased in the refractory material.

16. A metallurgical lance as in claim 6, wherein the tubular reinforcing members are connected to a manifold to provide for the passage of cooling fluid through the reinforcing members.

* * * * *